US006910792B2

(12) United States Patent
Takada et al.

(10) Patent No.: US 6,910,792 B2
(45) Date of Patent: Jun. 28, 2005

(54) PROJECTION-TYPE VEHICULAR HEADLAMP HAVING IMPROVED LATERAL ILLUMINATION

(75) Inventors: Kenichi Takada, Shizuoka (JP); Koji Okawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 160 days.

(21) Appl. No.: 10/634,920

(22) Filed: Aug. 6, 2003

(65) Prior Publication Data

US 2004/0027836 A1 Feb. 12, 2004

(30) Foreign Application Priority Data

Aug. 9, 2002 (JP) ..... P. 2002-232368

(51) Int. Cl.[7] ..... F21V 7/09; F21V 13/04

(52) U.S. Cl. ..... 362/539; 362/298; 362/300; 362/346; 362/518

(58) Field of Search ..... 362/298–305, 362/346, 517, 518, 538

(56) References Cited

U.S. PATENT DOCUMENTS 4,772,987 A 9/1988 Kretschmer et al.
4,928,214 A * 5/1990 Oyama ..... 362/518
5,305,189 A 4/1994 Sekiguchi
5,567,034 A * 10/1996 Dietewich et al. ..... 362/538
5,902,039 A * 5/1999 Futami ..... 362/539
6,439,745 B2 * 8/2002 Futami ..... 362/298
6,454,448 B2 * 9/2002 Taniuchi et al. ..... 362/517
6,575,609 B2 * 6/2003 Taniuchi et al. ..... 362/517

* cited by examiner

*Primary Examiner*—Alan Cariaso
(74) *Attorney, Agent, or Firm*—Sughrue Mion, PLLC

(57) ABSTRACT

A vehicular headlamp which radiates a beam forward in a predetermined low-beam light distribution pattern using a projection-type lamp unit and with which visibility to the sides of a vehicle is improved without having a significant effect on the formation of the low-beam light distribution pattern. A first additional reflector for reflecting light from a discharge light source of a discharge bulb forward is disposed below a discharge bulb of the projection-type lamp unit. A second additional reflector for reflecting reflected light from the first additional reflector to one side is provided in front of the first additional reflector. An additional light distribution pattern that partially overlaps a side portion of the low-beam light distribution pattern is formed, thereby providing improved illumination of road zones to the sides of the vehicle. Although a lower portion of a reflector is cut away in order to receive both additional reflectors, this does not significantly affect formation of the low-beam light distribution pattern.

13 Claims, 6 Drawing Sheets

PROJECTION-TYPE VEHICULAR HEADLAMP HAVING IMPROVED LATERAL ILLUMINATION

REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING A TABLE, OR A COMPUTER PROGRAM LISTING COMPACT DISK APPENDIX

Not applicable

BACKGROUND OF THE INVENTION

The present invention relates to a vehicular headlamp employing a projection-type lamp unit.

Conventionally, a vehicular headlamp constructed so as to radiate a beam forward using, a projection-type lamp unit has been known.

The projection-type lamp unit is constructed so as to converge and reflect light from a light source, which is disposed on an optical axis extending in the lengthwise direction of a vehicle forward towards the optical axis using a reflector, and radiate the reflected light to the front of the lamp via a projection lens provided in front of the reflector. If this projection-type lamp unit is constructed for low beam radiation, a shade for partially blocking reflected light from the reflector is provided between the projection lens and the reflector.

For low-beam radiation, illuminating road zones on the sides of the vehicle and the like, in addition to the road ahead of the vehicle, is desirable. However, since the lateral diffusion angle of light radiated to the front of the lamp via the projection lens is inherently limited by the properties of the lens, there is a problem in that the projection-type lamp unit may be incapable of sufficiently illuminating the road zones on the sides of the vehicle.

Taking the foregoing into consideration, it is an object of the present invention to provide a vehicular headlamp constructed so as to radiate a beam forward in a predetermined low-beam light distribution pattern using a projection-type lamp unit and which is capable of improving visibility to the sides of the vehicle without having a significant effect on the formation of the low-beam light distribution pattern.

BRIEF SUMMARY OF THE INVENTION

The present invention achieves the above object by providing two types of additional reflectors in a predetermined arrangement.

That is, the vehicular headlamp according to the present invention is constructed so as to radiate a beam forward in a predetermined low-beam light distribution pattern using a projection-type lamp unit comprising a light source disposed on an optical axis extending in a vehicle lengthwise direction a reflector for converging and reflecting light from the light source forward towards the optical axis, a projection lens provided in front of the reflector, and a shade provided between the projection lens and the reflector to partially block reflected light from the reflector. A first additional reflector for reflecting light from the light source forward is provided below the light source, and a second additional reflector for reflecting reflected light from the first additional reflector sideward to form an additional light distribution pattern that partially overlaps a lateral portion of the low-beam light distribution pattern is provided in front of the first additional reflector.

The specific type of light source is not particularly limited. For example, it is possible to employ the light source of a discharge bulb, a filament of an incandescent bulb such as a halogen bulb, or the like.

The specific structure of the first additional reflectors, including, size and reflecting surface shape, is not particularly limited as long as the structure is disposed below the light source and light from the light source is reflected forward.

The specific structure of the second additional reflector, including size and reflecting surface shape, is also not particularly limited as long as the structure is such that reflected light from the first additional reflector is reflected sideward to form an additional light distribution pattern that partially overlaps the lateral portion of the low-beam light distribution pattern.

As described above, the vehicular headlamp according to the present invention is constructed such that a beam is radiated forward in the predetermined low-beam light distribution pattern by the projection-type lamp unit. The first additional reflector for reflecting light from the light source forward is provided below the light source of the lamp unit, and the second additional reflector for reflecting reflected light from the first additional reflector sideward to form the additional light distribution pattern that partially overlaps the lateral portion of the low-beam light distribution pattern is provided in front of the first additional reflector. Accordingly, road zones to the sides of the vehicle can be sufficiently illuminated, thereby allowing improvement of visibility to the sides of the vehicle.

In the reflector of the projection-type lamp unit, a portion that significantly contributes to formation of a cut-off line or a hot zone, which are primary characteristics of the low-beam light distribution pattern, is an area near the optical axis and an area on both left and right sides thereof. According to the present invention, since the first additional reflector is provided below the light source and the second additional reflector is provided in front thereof, the arrangement of these additional reflectors does not constitute a significant hindrance to formation of the cut-off line or the hot zone.

As described above, according to the present invention, with the vehicular headlamp constructed so as to radiate a beam forward in the predetermined low-beam light distribution pattern by the projection-type lamp unit, visibility to the sides of the vehicle is improved without having a significant effect on the formation of the low-beam light distribution pattern.

In the above construction, if the first additional reflector is structured so as to reflect light from the light source in a direction inclined at a predetermined angle toward sides laterally opposite to the light reflecting direction of the second additional reflector with respect to the optical axis, the first and second additional reflectors can be compactly disposed below the reflector.

Furthermore, in a case where a translucent cover is provided at the front of the lamp unit which extends rearward from an inner side in a vehicle widthwise direction towards an outer side in the vehicle widthwise direction, if the second additional reflector is structured so as to reflect reflected light from the first additional reflector towards the outer side in the vehicle widthwise direction, the side zones of the vehicle can be sufficiently illuminated without being blocked by the lamp body or the like. As a result, visibility to the sides of the vehicle is reliably secured.

DETAILED DESCRIPTION OF THE INVENTION

A description will be given below of preferred embodiments constructed according to the present invention with reference to the accompanying drawings.

Figure 1:
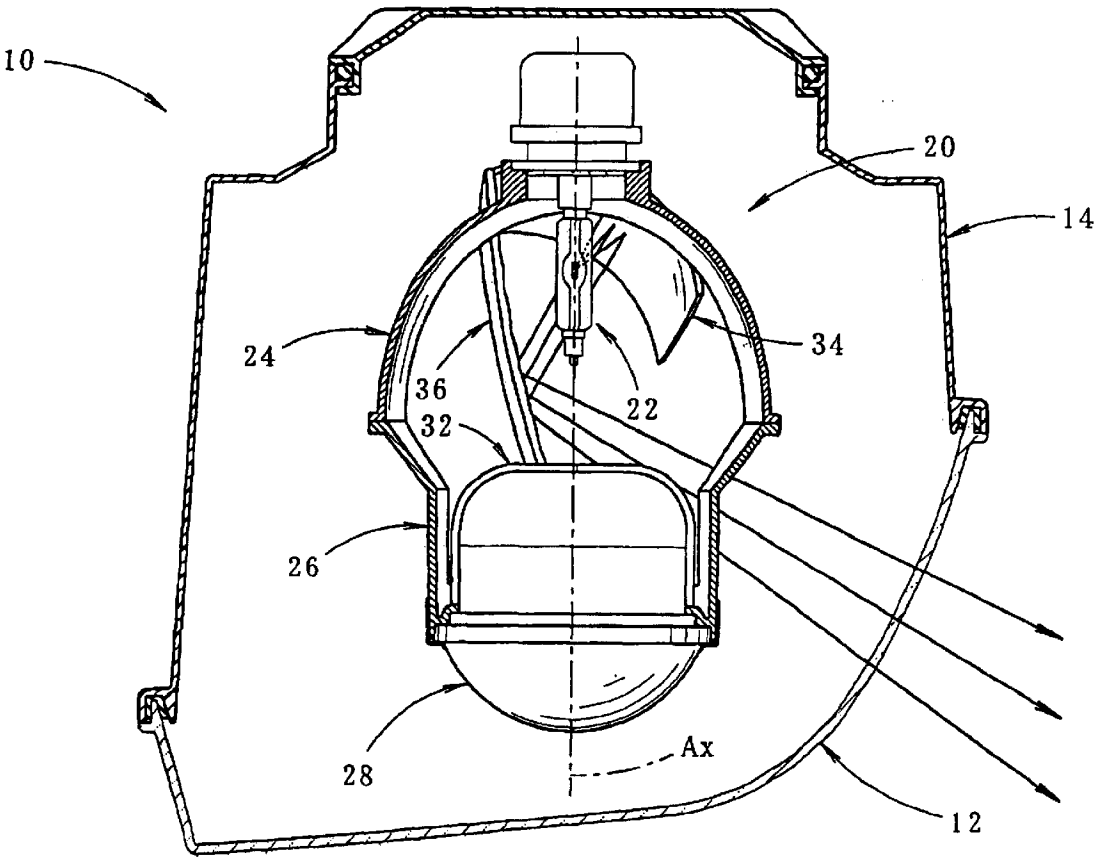
FIG. 1 is a cross-sectional view taken in a horizontal plane showing a vehicular headlamp constructed according to a preferred embodiment of the present invention.

FIG. 1 is a cross-sectional view taken in a horizontal plane showing, a vehicular headlamp constructed according, to a first preferred embodiment of the present invention.

As shown in the drawing, a vehicular headlamp 10 is a lamp intended to be mounted at a left corner portion of the front portion of a vehicle. The lamp is structured such that a projection-type lamp unit 20 is mounted within a lamp chamber constituted by a plain translucent cover 12 and a lamp body 14 via an aiming mechanism (not shown) so as to be vertically and horizontally tiltable.

The translucent cover 12 is formed to conform to a vehicle body contour at the left corner portion of the front end of the vehicle so as to curve around to the rear from an inner side in a vehicle widthwise direction towards an outer side in the vehicle widthwise direction.

Figure 2:
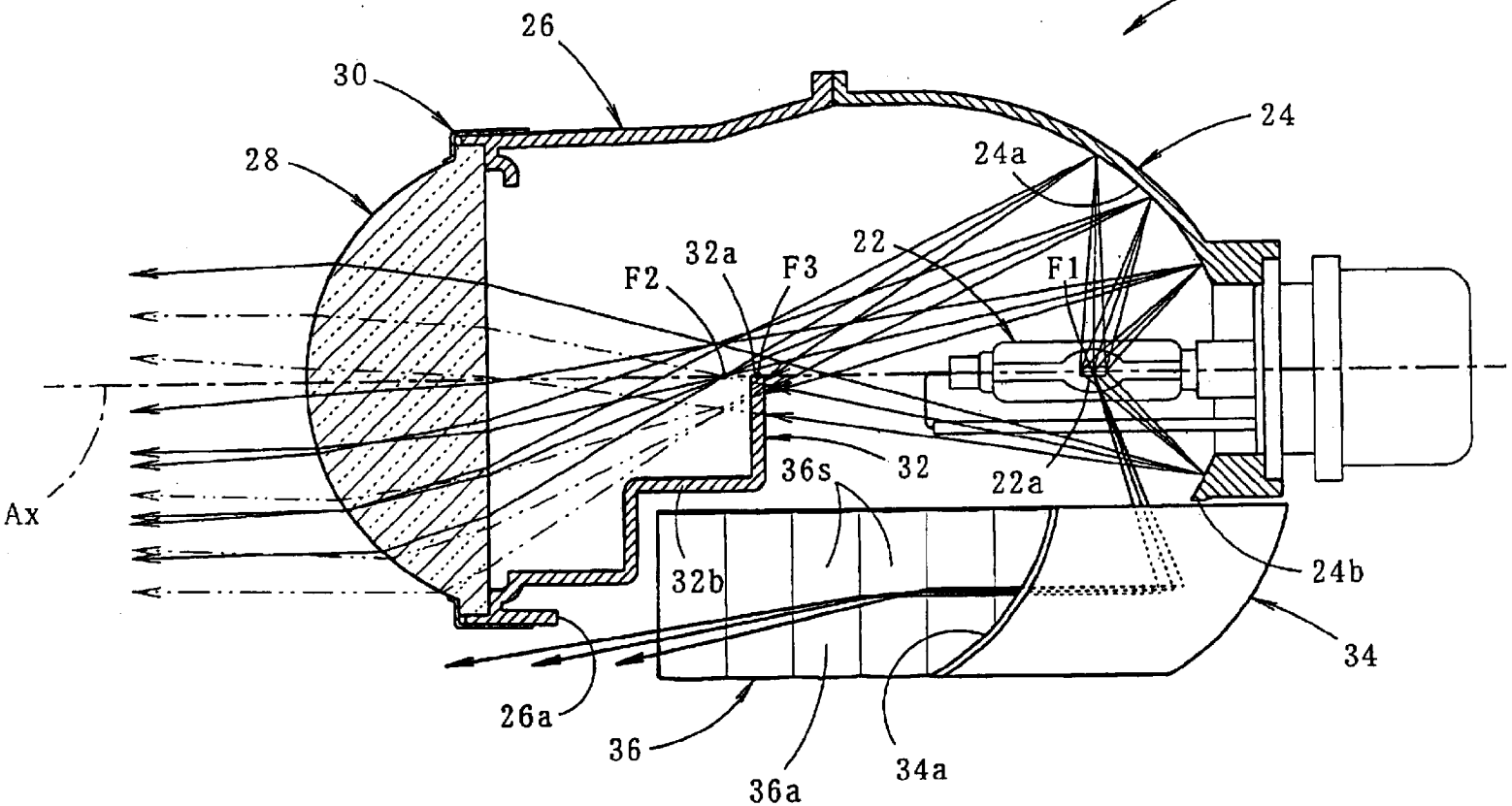
FIG. 2 is a cross-sectional view taken in a vertical plane showing an individual lamp unit of the vehicular headlamp of FIG. 1.
Figure 3:
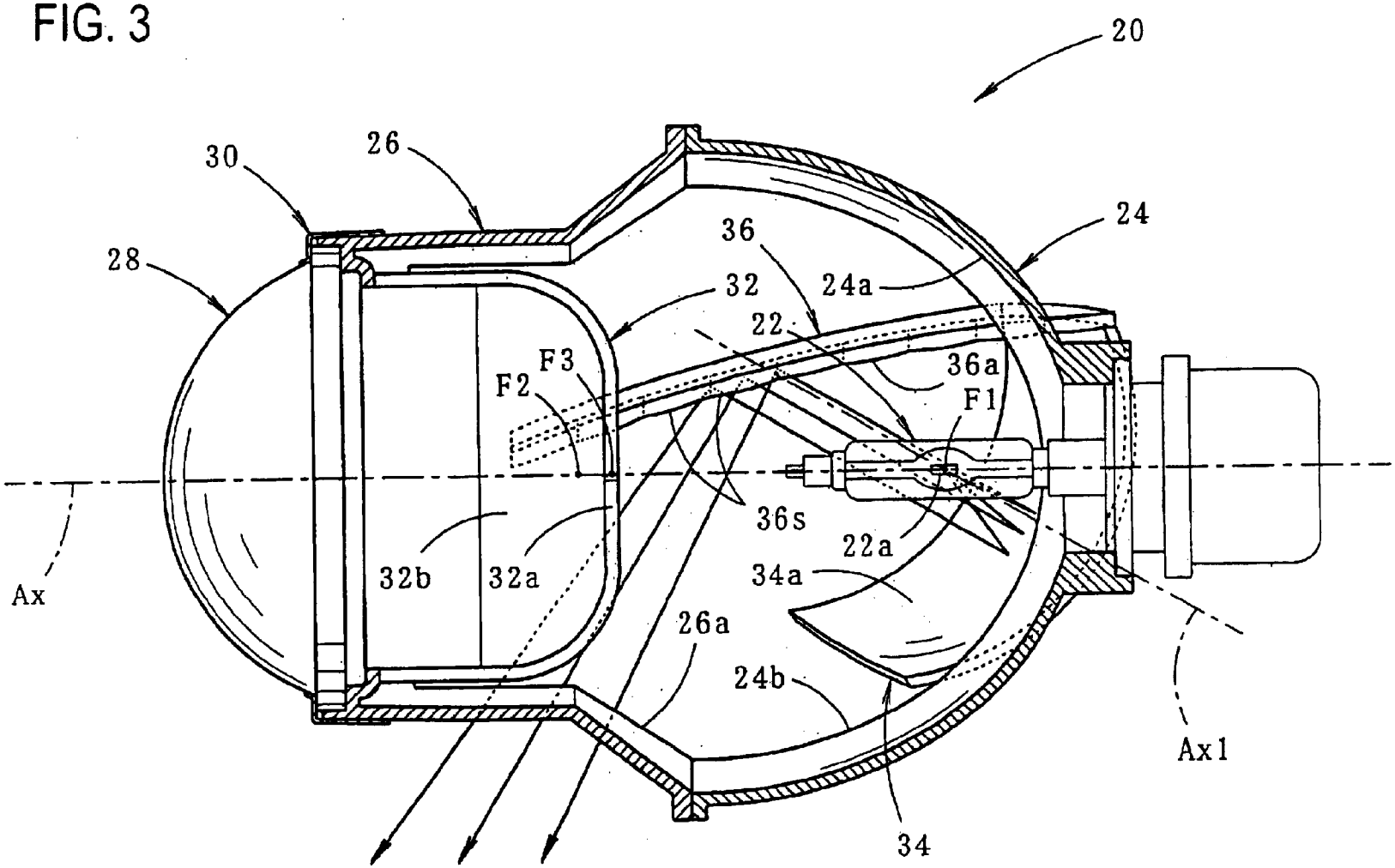
FIG. 3 is a cross-sectional view taken in a horizontal plane showing the individual lamp unit.

FIGS. 2 and 3 are cross-sectional views taken in horizontal and vertical planes, respectively, showing an individual lamp unit 20.

As shown in these drawings, the lamp unit 20 is constructed as a lamp unit for low-beam radiation, and it includes a discharge bulb 22, a reflector 24, a holder 26, a projection lens 28, a retaining ring 30, a shade 32, a first additional reflector 34, and a second additional reflector 36.

The discharge bulb 22, which is a metal halide bulb, is fixed to the reflector 24 in such a manner that a discharge light source 22*a* (light source) is disposed generally coaxially with an optical axis Ax extending in the lengthwise direction of the vehicle on which the lamp is mounted, more precisely, a direction approximately 0.5° to 0.6° downward with respect to the vehicle lengthwise direction.

The reflector 24 includes a reflecting surface 24*a* of a generally ellipsoidal and spherical shape, with the optical axis Ax as a central axis. The reflecting surface 24*a* has a cross-sectional shape in the form of an ellipsoid about the optical axis Ax whose eccentricity gradually increases from a vertical cross section towards a horizontal cross section. The rear apex of the ellipsoid forming each of these cross sections is set at the same position. The discharge light source 22*a* is disposed at a first focal point F1 of the ellipsoid forming the vertical cross section of the reflecting surface 24*a*. Due to this construction, the reflecting surface 24*a* converges and reflects light from the discharge light source 22*a* forward towards the optical axis Ax. In this case, light is substantially converged on a second focal point F2 of the ellipsoid within the vertical cross section including the optical axis Ax.

A notched portion 24*b* is formed in the lower portion of the reflector 24. The notched portion 24*b* is formed by horizontally cutting away the reflector 24 at positions within predetermined dimensions, for example, portions approximately 15 mm) below the optical axis Ax.

The holder 26 is formed in a cylindrical shape extending forward from a front end opening portion of the reflector 24. A rear end portion of the holder 26 is fixedly supported by the reflector 24, and a front end portion thereof fixedly supports the projection lens 28 via the retaining ring 30. A lower portion of the holder 26 is also provided with a notched portion 26*a*.

The projection lens 28 has the form of a planoconvex lens, the front surface of which is a convex surface and the rear surface of which is a flat surface. The projection lens 28 has a rear focal point F3 disposed on the optical axis Ax with the focal point F3 located slightly rearward of the second focal point F2 of the reflecting surface 24*a* of the reflector 24. Thus an image formed on a focal plane including the rear focal point F3 is projected forward as an inverted image.

Figure 4:
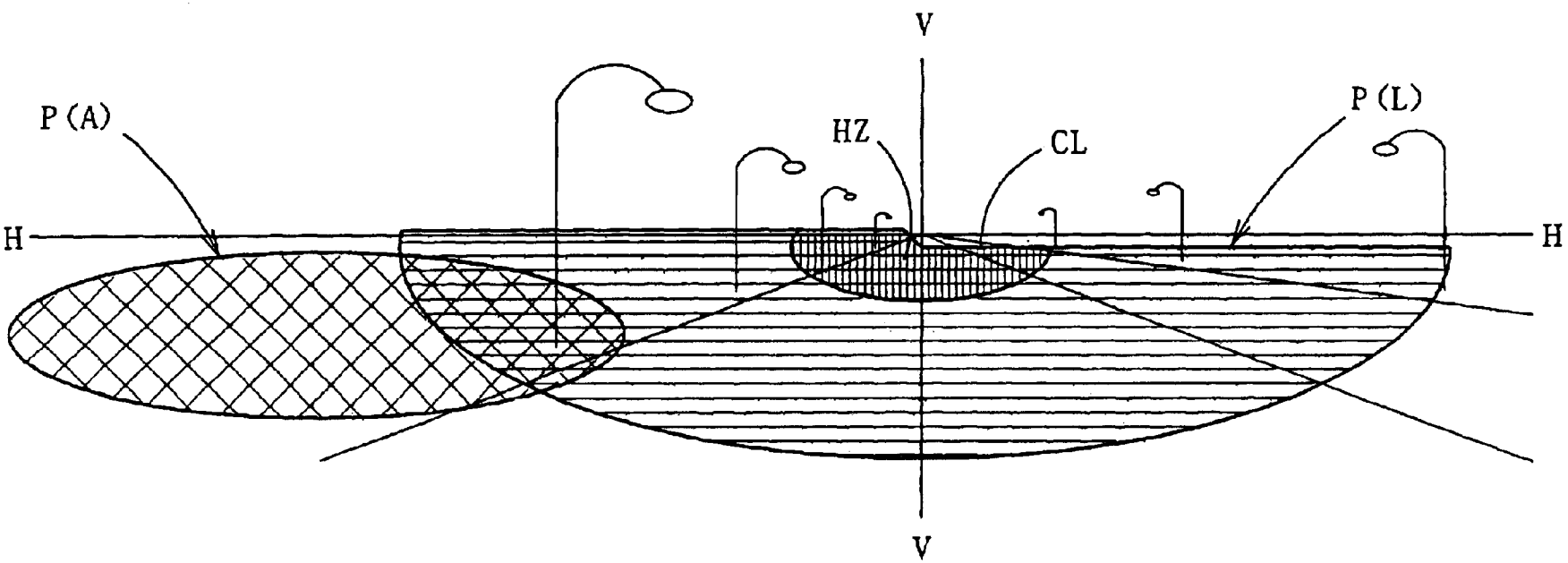
FIG. 4 shows a light distribution pattern formed by a beam radiated from the lamp unit on an imaginary vertical screen located at a position 25 meters in front of the lamp.

The shade 32 extends generally in a vertical plane perpendicularly to the optical axis Ax, and both left and right end portions thereof are formed integrally with the holder 26 so as to curve around to the front side. A stepped upper edge 32*a* of the shade 32 is disposed so as to pass through the second focal point F2. The shade 32 partially blocks reflected light from the reflecting surface 24*a* of the reflector 24 to eliminate upward-radiated light emitted from the lamp unit 20, thereby obtaining radiated light pattern suitable for a low headlamp beam (the beam indicated by a solid line in FIG. 2) that is directed downward with respect to the optical axis Ax. As a result, a left-side low-beam light distribution pattern P(L) as shown in FIG. 4 is formed. The low-beam light distribution pattern P(L) includes a so-called Z-shaped cut-off line having a level difference between left and right sides thereof, and a hot zone (area of high-intensity light) HZ at an upper end center portion.

The first additional reflector 34, which is provided below the discharge bulb 22, reflects light from the discharge light source 22*a* thereof forward. The reflecting surface 34*a* of the first additional reflector 34, which has the position of the first focal point F1 of the reflector 24 as a focal point, is formed as a paraboloid of revolution having an axis line Ax1 as a central axis inclined to the right at a predetermined angle, for example 30°, with respect to the optical axis Ax. Thus, light from the discharge light source 22*a* is reflected as parallel light beam directed rightward at the predetermined angle, forward in the direction of the optical axis Ax.

The second additional reflector 36, which is provided in front of the first additional reflector 34, reflects parallel light flux from the first additional reflector 34 leftward. In this case, reflected light from the second additional reflector 36 is radiated to the outer side in the vehicle widthwise direction through a portion of the translucent cover 12 which extends around to the rear as shown in FIG. 1.

The reflecting surface 36*a* of the second additional reflector 36 is divided into vertical stripes and is composed of a plurality of diffusing reflective elements 36*s* inclined slightly downward with respect to the vertical plane, whereby the parallel light flux from the first additional reflector 34 is diffused slightly downward in a horizontal direction. Thus, as shown in FIG. 4, an additional light distribution pattern P(A) that partially overlaps a left portion of the low-beam light distribution pattern P(L) is formed.

Since the lateral diffusion angle of the low-beam light distributional pattern P(L) can be increased up to approximately 60° on a side with respect to a line V-V, namely a vertical line passing through the H-V intersection (a point in the forward direction of the lamp), the position of the additional light distribution pattern P(A) is preferably set such that the center thereof is located approximately 60° to 70° to the left with respect to the line V-V.

The first and second additional reflectors 34 and 36 are positioned within the notched portion 24*b* of the reflector 24 and the notched portion 26*a* of the holder 26, respectively, and are fixed to the reflector 24 via fixing means (not shown). The shade 32 is provided with a stepped portion 32*b* for preventing interference with the front end portion of the second additional reflector 36.

As described in detail above, the vehicular headlamp 10 according to the first embodiment is constructed such that a beam is radiated forward in a low-beam light distribution pattern P(L) including the cut-off line CL by the projection-type lamp unit 20. The first additional reflector 34 for reflecting light from the discharge light source 22*a* forward is provided below the discharge bulb 22 of the lamp unit 20. Furthermore, the second additional reflector 36 for reflecting reflected light from the first additional reflector 34 leftward to form the additional light distributional pattern P(A), which partially overlaps the lateral portion of the low-beam light distribution pattern P(L), is positioned in front of the first additional reflector 34. Accordingly, road zones on the sides of the vehicle and the like can be sufficiently illuminated, thereby providing improved visibility to the sides of the vehicle.

According to the first embodiment, although a lower portion of the reflector 24 is eliminated in order to mount the first and second additional reflectors 34 and 36, since the portion of the reflector 24 that significantly contributes to formation of the cut-off line CF and the hot zone HZ is an area near the optical axis Ax and an area on both left and right sides thereof, visibility to the sides of the vehicle is improved without having a significant effect on the formation of the desired low-beam light distribution pattern P(L).

According to the first embodiment, since the first additional reflector 34 is structured so as to reflect light from the discharge light source 22*a* in a direction inclined at a predetermined angle toward sides laterally opposite to the light reflecting direction of the second additional reflector with respect to the optical axis Ax, the first and second additional reflectors 34 and 36 can be made compact and disposed below the reflector 24.

Furthermore, the vehicular headlamp 10 according to the present embodiment is constructed such that the translucent cover 12 provided at the front of the lamp unit 20 curves around to the rear from the inner side in the vehicle widthwise direction towards the outer side in the vehicle widthwise direction. However, since the second additional reflector 36 reflects reflected light from the first additional reflector 34 towards the outer side in the vehicle widthwise direction, side zones of the vehicle can be sufficiently illuminated without being blocked by the lamp body 14 or the like. As a result, improved visibility to the sides of the vehicle is reliably secured.

Furthermore, since the reflecting surface 34*a* of the first additional reflector 34 has the shape of a paraboloid of revolution by which parallel light flux is incident on the second additional reflector 36, reflection control by the second additional reflector 36 can be accurately achieved. Moreover, since the reflecting surface 36*a* of the second additional reflector 36 is composed of a plurality of diffusing reflective element 36*s*, the luminous intensity distribution of the additional light distribution pattern P(A) is made uniform and the occurrence of luminescent unevenness effectively suppressed.

Instead of structuring the reflecting, surface 34*a* of the first additional reflector 34 as a paraboloid of revolution as in the present embodiment it may of course be structured as another form of curved surface such as an ellipsoidal or spherical surface or the like. In addition, it is of course also possible to structure the reflecting surface 36*a* of the second additional reflector 36 as a single curved surface or the like.

A description has been given regarding a case where the lamp unit 20 is provided in the vehicular headlamp 10 at the left corner portion of the front end of the vehicle. However, if the lamp unit is provided in a vehicular headlamp mounted at the right corner portion of the front end of the vehicle, if the first and second additional reflectors 34 and 36 are laterally inverted, visibility on the right side of the vehicle can be improved as in the present embodiment.

Next, a description will be given of a second embodiment of the invention.

Figure 5:
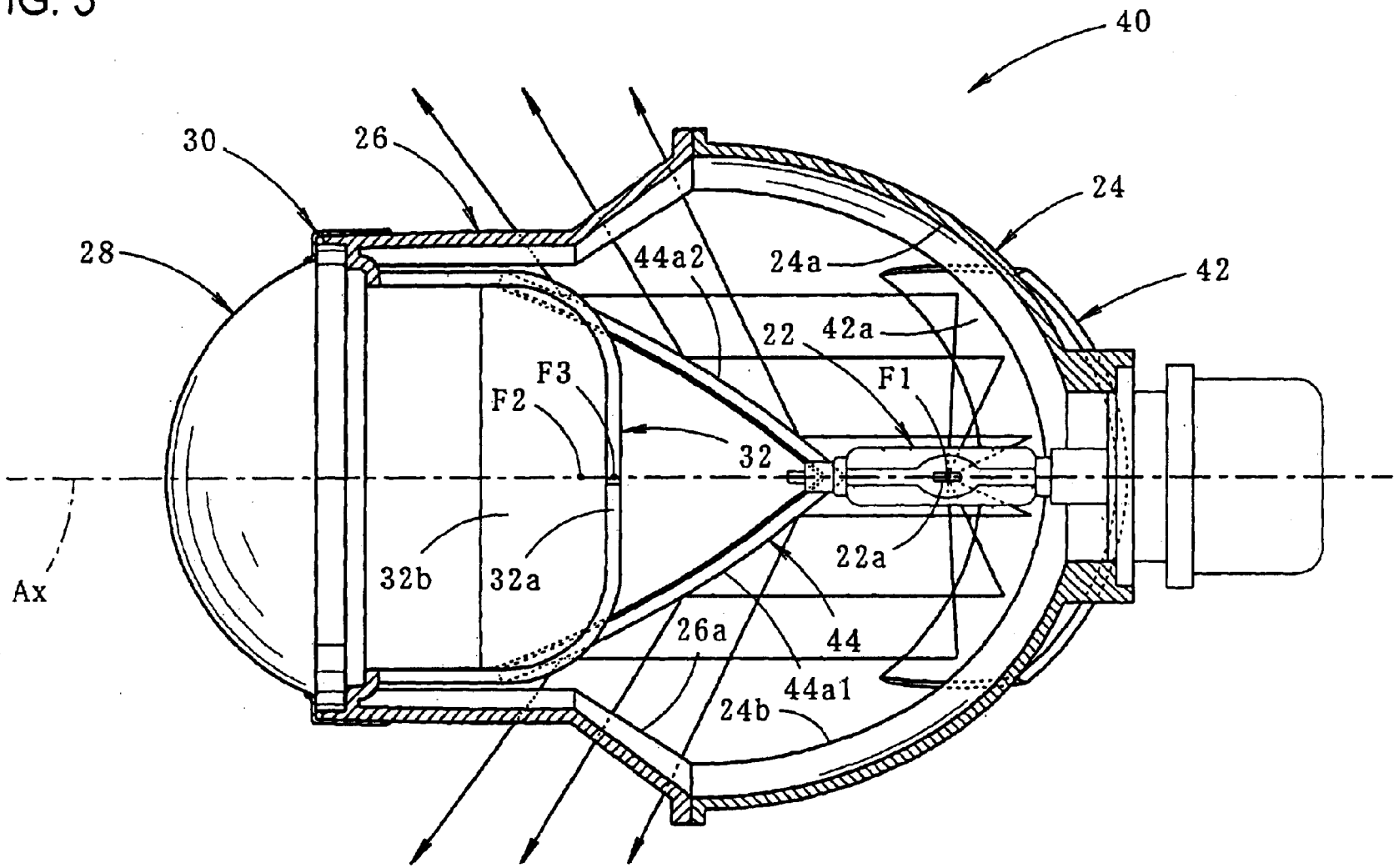
FIG. 5 is a view similar to FIG. 3 showing a second embodiment of the lamp unit.

FIG. 5 is a cross-sectional view taken in a horizontal plane showing a lamp unit 40 constructed according to the second embodiment.

As shown in the drawing a lamp unit 40 according to the second embodiment is the same as the lamp unit 20 of the first embodiment with respect to basic construction, but differs in the construction of first and second additional reflectors 42 and 44.

The first additional reflector 42, which is identical in structure to the first additional reflector 34 in the first embodiment, is mounted below the discharge bulb 22 and reflects light from the discharge light source 22*a* forward. However, the reflecting surface 42*a* of the first additional reflector 42 has the position of the first focal point F1 of the reflector 24 as a focal point, and is formed as a paraboloid of revolution having the optical axis Ax as its central axis. Therefore, light from the discharge light source 22*a* is reflected as a parallel light flux forward in the direction of the optical axis Ax.

The second additional reflector 44 is provided in front of the first additional reflector 42, and is structured so as to reflect the parallel light flux from the first additional reflector 42 leftward and rightward. In order to achieve this, the second additional reflector 44 is arranged in such a manner as to straddle the optical axis Ax in a generally V-shaped form in a plane view, and both left and right sides thereof are provided with a left-side reflecting surface 44*a*1 and a right-side reflecting surface 44*a*2, respectively.

Figure 6:
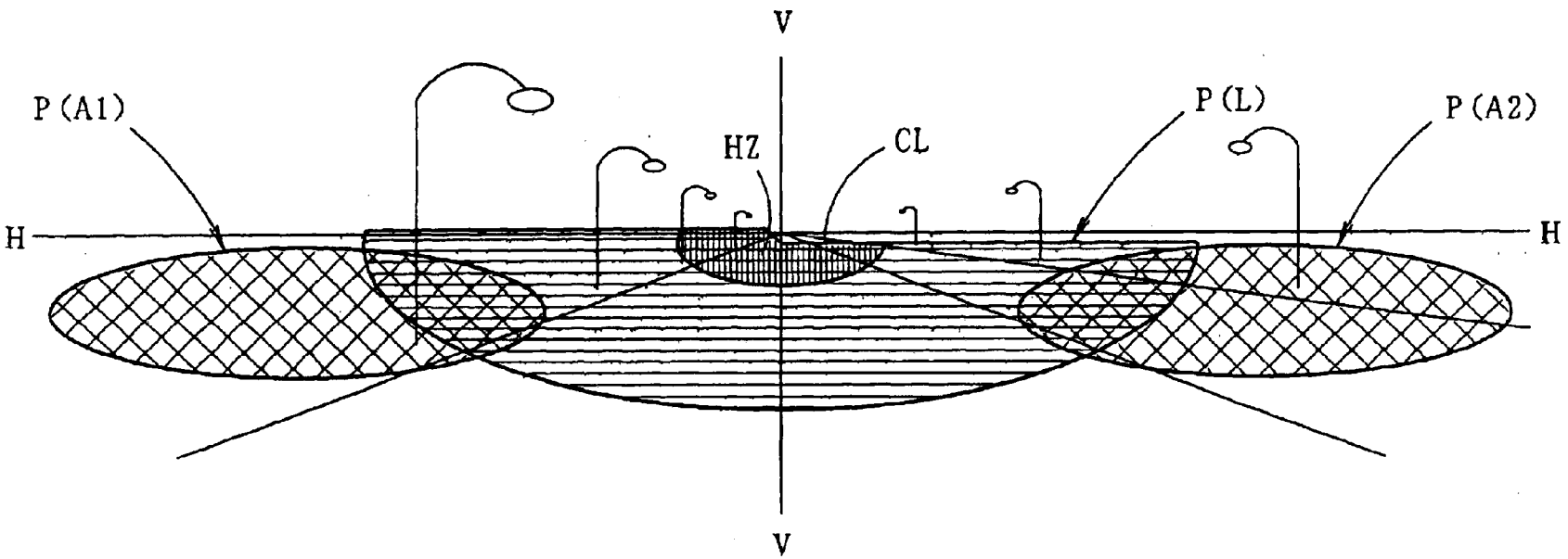
FIG. 6 is a view similar to FIG. 4 showing a light distribution pattern formed by a beam radiated from the lamp unit according to the second embodiment.

The left-side reflecting surface 44*a*1 and the right-side reflecting surface 44*a*2 are each constituted by a convex curved surface slightly inclined downward, and are structured so as to diffuse the parallel light flux from the first additional reflector 34 slightly downward in a horizontal direction. Thus, as shown in FIG. 6, an additional light distribution pattern P(A1) that partially overlaps the left portion of the low-beam light distribution pattern P(L) and an additional light distribution pattern P(A2) that partially overlaps the right portion of the low-beam light distribution pattern P(L) are formed.

The position of the additional light distribution pattern P(A1) is preferably set so that the center is located approximately 60° to 70° to the left with respect to the line V-V. The position of the additional light distribution pattern P(A2) is preferably set so that the center is located approximately 60° to 70° to the right with respect to the line V-V.

By employing the structure according to the second embodiment, visibility on both left and right sides of the vehicle can be improved without having a significant effect on the formation of the low-beam light distribution pattern P(L).

It should further be apparent to those skilled in the art that various changes in form and detail of the invention as shown and described above may be made. It is intended that such changes be included within the spirit and scope of the claims appended hereto.

What is claimed is:

1. A vehicular headlamp for radiating a light beam forward in a predetermined low-beam light distributional pattern, comprising:

a projection-type lamp unit comprising a light source disposed on an optical axis extending generally in a vehicle lengthwise direction, a reflector for converging and reflecting light from the light source forward towards said optical axis, a projection lens disposed in front of said reflector, and a shade disposed between said projection lens and said reflector for partially blocking reflected light from said reflector;

a first additional reflector for reflecting light from said light source forward disposed below said light source; and a second additional reflector for reflecting reflected light from said first additional reflector sideward to form an additional light distribution pattern partially overlapping a lateral portion of said low-beam light distribution pattern, said second additional reflector being provided in front of said first additional reflector.

2. The vehicular headlamp according to claim 1, wherein said first additional reflector reflects light from said light source in a direction inclined at a predetermined angle toward sides laterally opposite to a light reflecting direction of said second additional reflector with respect to said optical axis.

3. The vehicular headlamp according to claim 1, further comprising a translucent cover provided at a front side of said lamp unit, said translucent cover curving around to the rear from an inner side in a vehicle widthwise direction to an outer side in said vehicle widthwise direction is provided in front of the lamp unit, and wherein said second additional reflector reflects reflected light from said first additional reflector towards said outer side in the vehicle widthwise direction.

4. The vehicular headlamp according to claim 1, further comprising a lens holder for supporting said projection lens on said reflector, wherein said first additional reflector is disposed in a notched portion of said reflector, and said second additional reflector is disposed in a notched portion of said lens holder.

5. A vehicular headlamp for radiating a light beam forward in a predetermined low-beam light distribution pattern, comprising:

a projection-type lamp unit comprising a light source disposed on an optical axis extending generally in a vehicle lengthwise direction, a reflector for converging and reflecting light from the light source forward towards said optical axis, a projection lens disposed in front of said reflector, and a shade disposed between said projection lens and said reflector for partially blocking reflected light from said reflector;

a first additional reflector for reflecting light from said light source forward disposed below said light source, a reflecting surface of said first additional being shaped as a paraboloid of revolution having an axis inclined to a first side of said headlamp at a predetermined angle and having a focal point positioned at a first focal point of said reflector; and a second additional reflector for reflecting reflected light from said first additional reflector sideward to form an additional light distribution pattern partially overlapping a lateral portion of said low-beam light distribution pattern, said second additional reflector being provided in front of said first additional reflector, a reflecting surface of said second additional reflector being divided into a plurality of vertical stripes to provide a plurality of diffusing reflective elements inclinded downward with respect to a vertical plane such that light from said first additional reflector is diffused downward in a horizontal direction.

6. The vehicular headlamp according to claim 5, wherein said first additional reflector reflects light from said light source in a direction inclined at a predetermined angle toward sides laterally opposite to a light reflecting direction of said second additional reflector with respect to said optical axis.

7. The vehicular headlamp according to claim 5, further comprising a translucent cover provided at a front side of said lamp unit, said translucent cover curving around to the rear from an inner side in a vehicle widthwise direction to an outer side in said vehicle widthwise direction is provided in front of the lamp unit and wherein said second additional reflector reflects reflected light from said first additional reflector towards said outer side in the vehicle widthwise direction.

8. The vehicular headlamp according to claim 5, further comprising a lens holder for supporting said projection lens on said reflector, wherein said first additional reflector is disposed in a notched portion of said reflectors, and said second additional reflector is disposed in a notched portion of said lens holder.

9. A vehicular headlamp for radiating a light beam forward in a predetermined low-beam light distribution pattern, comprising:

a projection-type lamp unit comprising a light source disposed on an optical axis extending generally in a vehicle lengthwise direction, a reflector for converging and reflecting light from the light source forward towards said optical axis, a projection lens disposed in front of said reflector, and a shade disposed between said projection lens and said reflector for partially blocking reflected light from said reflector;

a first additional reflector for reflecting light from said light source forward disposed below said light source, a reflecting surface of said first additional being shaped as a paraboloid of revolution having a focal point positioned at a first focal point of said reflector and having an optical axis of said projection lens as a central axis; and a second additional reflector for reflecting reflected light from said first additional reflector sideward to form an additional light distribution pattern partially overlapping a lateral portion of said low-beam light distribution pattern, said second additional reflector being provided in front of said first additional reflector, a reflecting surface of said second additional reflector being substantially V-shaped straddling said optical axis of said projection lens.

10. The vehicular headlamp according to claim 9, wherein each side of said reflecting surface of said second additional reflector is formed as a convex curved surface inclinded downward for diffusing, a parallel light flux from said first additional reflector downward in a horizontal direction.

11. The vehicular headlamp according to claim 9, wherein said first additional reflector reflects light from said light source in a direction inclined at a predetermined angle toward sides laterally opposite to a light reflecting direction of said second additional reflector with respect to said optical axis.

12. The vehicular headlamp according to claim 9, further comprising a translucent cover provided at a front side of said lamp unit, said translucent cover curving around to the rear from an inner side in a vehicle widthwise direction to an outer side in said vehicle widthwise direction is provided in front of the lamp unit, and wherein said second additional reflector reflects reflected light from said first additional reflector towards said outer side in the vehicle widthwise direction.

13. The vehicular headlamp according to claim 9, further comprising an lens holder for supporting said projection lens on said reflector, wherein said first additional reflector is disposed in a notched portion of said reflector, and said second additional reflector is disposed in a notched portion of said lens holder.

* * * * *